US006252552B1

(12) United States Patent
Tarvas et al.

(10) Patent No.: US 6,252,552 B1
(45) Date of Patent: Jun. 26, 2001

(54) PLANAR DUAL-FREQUENCY ANTENNA AND RADIO APPARATUS EMPLOYING A PLANAR ANTENNA

(75) Inventors: Suvi Tarvas; Jyrki Mikkola, both of Oulu; Sauli Kivelä, Kuusamo; Anne Isohätälä, Kello, all of (FI)

(73) Assignee: Filtronic LK Oy, Kempele (FI)

( * ) Notice: Subject to any disclaimer, the term of this patent is extended or adjusted under 35 U.S.C. 154(b) by 0 days.

(21) Appl. No.: 09/477,907

(22) Filed: Jan. 5, 2000

(30) Foreign Application Priority Data

Jan. 5, 1999 (FI) ..... 990006

(51) Int. Cl.[7] ..... H01Q 1/38

(52) U.S. Cl. ..... 343/700 MS; 343/702; 343/718; 343/725

(58) Field of Search ..... 343/700 MS, 702, 343/718, 725, 843; H01Q 1/38

(56) References Cited

U.S. PATENT DOCUMENTS 4,692,769 9/1987 Gegan ..... 343/700 MS
5,568,155 * 10/1996 Tsunekawa et al. ..... 343/700 MS
5,764,190 * 6/1998 Murch et al. ..... 343/702
5,926,139 * 7/1999 Korisch ..... 343/702

FOREIGN PATENT DOCUMENTS

0484454B1 9/1994 (EP) .
982366 1/2000 (FI) .

* cited by examiner

*Primary Examiner*—Don Wong
*Assistant Examiner*—Shih-Chao Chen
(74) *Attorney, Agent, or Firm*—Darby & Darby

(57) ABSTRACT

A PIFA structure has a first operating frequency and a second operating frequency. It comprises a planar radiating element (801, 1002, 1101, 1203) which is a conductive area confined by a substantially continuous border line divided by a non-conductive slot (802). The slot has a first end on said substantially continuous border line and a second end within the conductive area. The planar radiating element comprises a feedpoint (803, 1206) and ground contact (804, 1208) near the first end of the slot so that the electrical length of the conductive area divided by the slot, measured at the feedpoint, equals a quarter of the wavelength at the first operating frequency and the electrical length of the slot equals a quarter of the wavelength at the second operating frequency.

10 Claims, 7 Drawing Sheets

PLANAR DUAL-FREQUENCY ANTENNA AND RADIO APPARATUS EMPLOYING A PLANAR ANTENNA

BACKGROUND OF THE INVENTION

1. Field of the Invention

The invention relates in general to planar antenna structures. In particular the invention relates to a planar structure combining two different antenna architectures, thus operating at two clearly distinct frequencies. In addition, the invention relates to the feed arrangement of such an antenna and to a radio apparatus employing such an antenna.

2. Description of the Related Art

Figure 1:
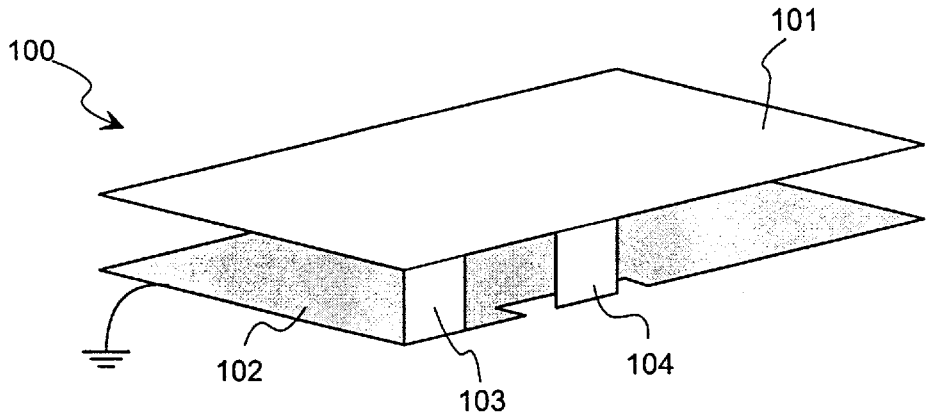
Fig. 1 PRIOR ART

FIG. 1 shows a known basic design 100 of a planar inverted-F antenna (PIFA) comprising a planar electrically conductive radiating element 101, electrically conductive ground plane 102 parallel to said radiating element, and, interconnecting these two, a ground contact 103 which is substantially perpendicular to the radiating element and ground plane. The structure further includes a feed electrode 104 which also is substantially perpendicular to the radiating element and ground plane and which can be coupled to an antenna port (not shown) of a radio apparatus. In the structure of FIG. 1 the radiating element 101, ground contact 103 and the feed electrode 104 are usually manufactured by cutting a thin metal sheet into a suitable rectangular shape which has got two protrusions bent to a right angle. The ground plane 102 may be a metallized area on the surface of a printed circuit board so that the ground contact 103 and feed electrode are easily connected to holes on the printed circuit board. The electrical characteristics of the antenna 100 are affected in general by the dimensions of its elements and in particular by the size of the radiating element 101 and its distance from the ground plane 102.

A disadvantage of the antenna structure depicted in FIG. 1 is its poor mechanical stability. Various structures have been proposed to solve this problem. European Patent document EP 484,454 discloses a PIFA structure according to FIG. 2 wherein a radiating element 201, ground plane 202 and a ground contact 203 interconnecting these two are realized as metal platings on surfaces of a solid dielectric body 204. The antenna is fed through a coupling element 205 which does not touch the radiating element 201. An electromagnetic coupling exists between the coupling element 205 and radiating element 201, and the coupling element extends over the edge of the dielectric body 204 to a point that can be coupled to the antenna port of a radio apparatus. The structure is mechanically stable, but the dielectric body block makes it rather heavy. Furthermore, the dielectric body decreases the impedance bandwidth of the antenna and degrades the radiation efficiency compared with an air-insulated PIFA.

Figure 2:
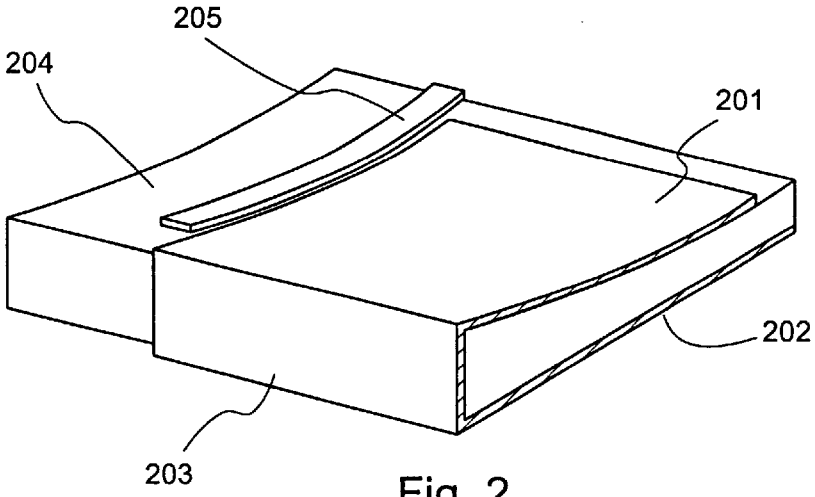
Fig. 2 PRIOR ART
Figure 3:
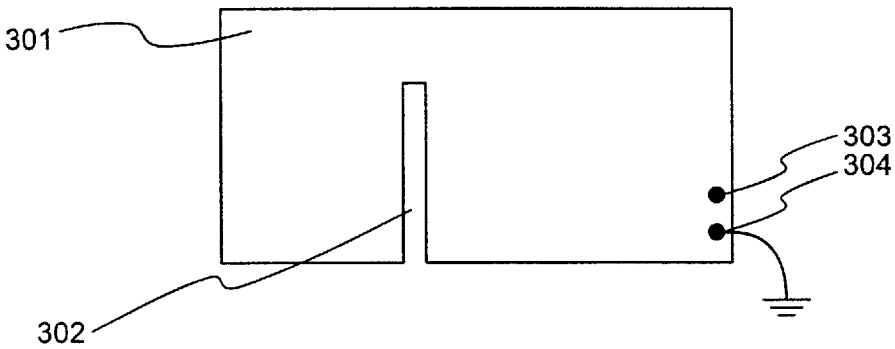
Fig. 3 PRIOR ART

A PIFA radiating element does not have to be a simple rectangle as in FIGS. 1 and 2. FIG. 3 shows a known PIFA radiating element 301 design. The rectangular shape is broken by a slot 302 which forms a sort of strip in that portion of the radiating element which is farthest away from the feedpoint 303 and ground contact 304. The purpose of the slot usually is to increase the electrical length of the antenna and thus affect the antenna's resonant frequency.

Figure 4A:
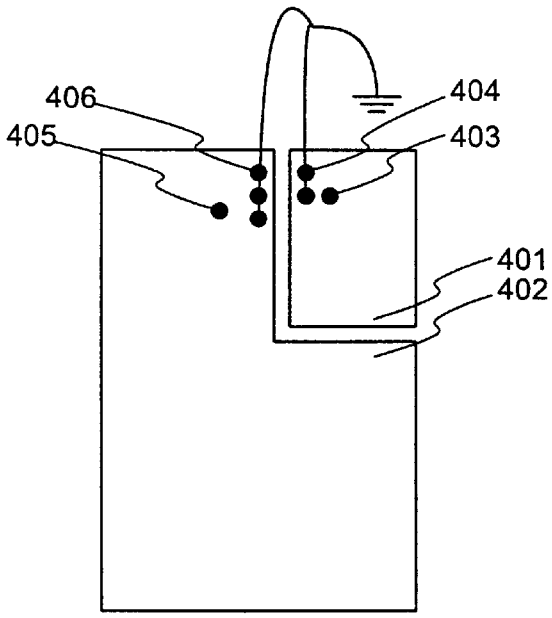
Fig. 4a PRIOR ART
Figure 4B:
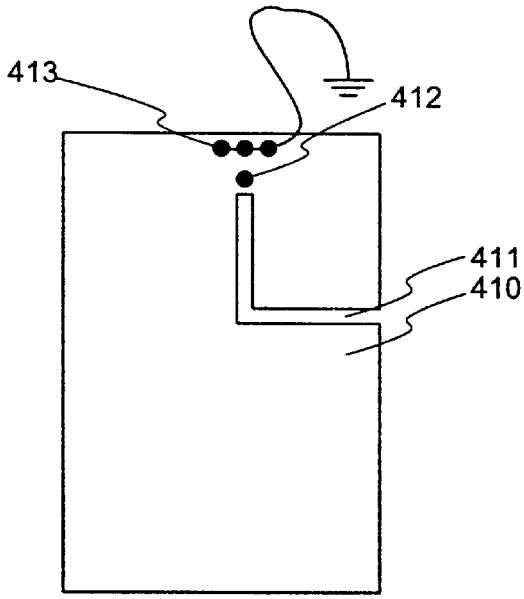
Fig. 4b PRIOR ART

All the PIFA structures described above are designed such that they have a certain resonant frequency as well as an operating frequency band centering round said resonant frequency. In some cases, however, it is preferable that the antenna of a radio apparatus has two different resonant frequencies. FIGS. 4*a* and 4*b* show dual-frequency PIFA radiating elements known from the publication "Dual-Frequency Planar Inverted-F Antenna" by Z. D. Liu, P. S. Hall, D. Wake, IEEE Transactions on Antennas and Propagation, Vol. 45, No. 10, October 1997, pp. 1451–1457. In FIG. 4*a* the antenna comprises a rectangular first radiating element 401 and a second radiating element 402 surrounding said first radiating element from two sides. The first radiating element has a feedpoint 403 and ground contact 404 of its own, and the second radiating element has those of its own, 405 and 406. In FIG. 4*b* the antenna comprises a continuous radiating element 410 which is divided into two branches by a slot 411. The feedpoint 412 is located near the inner end of the slot 413, i.e. the end that does not end at the edge of the radiating element, so that the branches have different directions from the feedpoint on. Both branches have electrical lengths of their own which differ from each other considerably. The ground contacts 413 are located near the edge of the structure.

Figure 5:
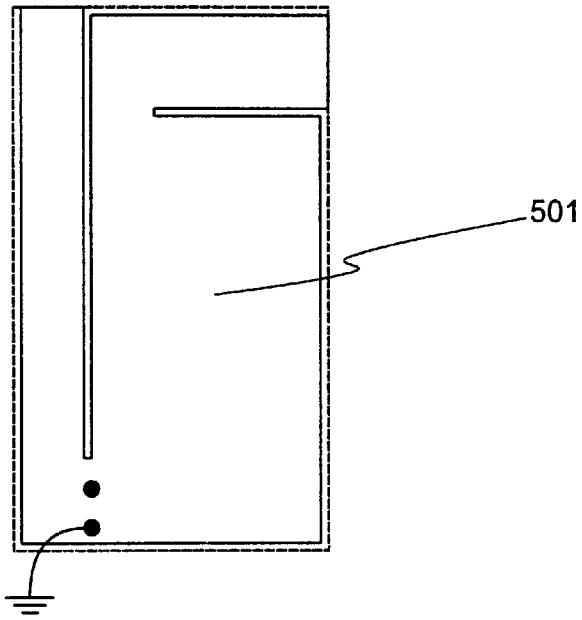
Fig. 5 PRIOR ART

It is further known a dual-frequency PIFA radiating element 501 according to FIG. 5 which has two branches in the same manner as the radiating element in FIG. 4*b*. In FIG. 5, the outermost ends of both branches extend to the edge of the printed circuit board, depicted in the figure by the dashed line, which supports the radiating element. This structure provides a somewhat wider antenna impedance band, i.e. frequency range around a particular resonant frequency in which the antenna impedance matching to the antenna port of the radio apparatus is good. At the same time, however, the SAR value, which indicates the amount of radiation absorbed by the user, becomes rather high, especially in the higher frequency band.

Figure 6:
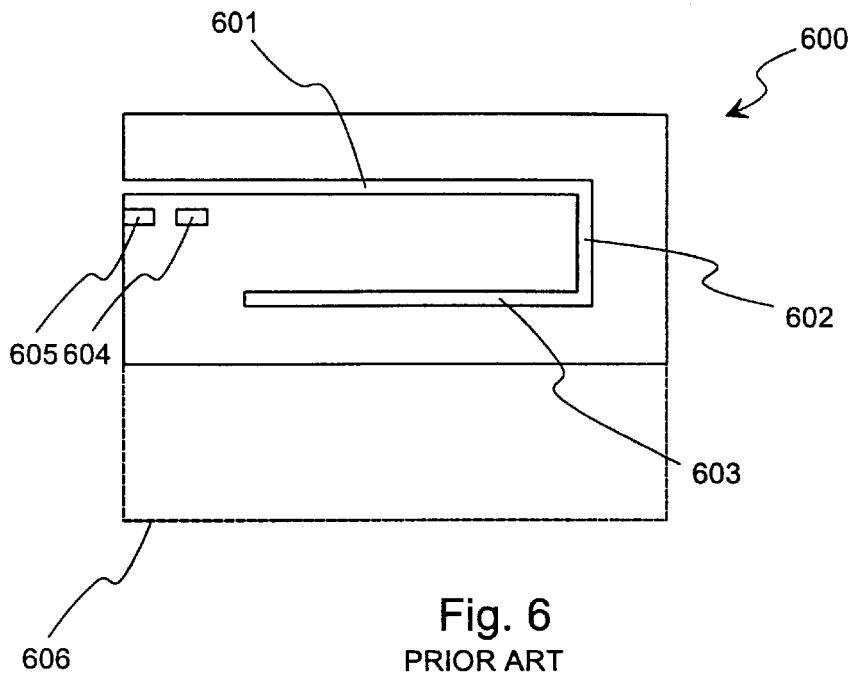
Fig. 6 PRIOR ART

Finnish patent application FI-982366 discloses a PIFA radiating element 600 according to FIG. 6, in which said radiating element is divided by a non-conductive slot 601-602-603 which divides the planar radiating element into a first branch and second branch. The feedpoint 604 and ground contact 605 are located close to the inner end of the slot. So, this structure, too, has two adjacent PIFA radiating element branches on one and the same planar surface and in the vicinity of one and the same ground plane 606. The patent application also discloses that the outer end of the branch corresponding to the higher operating frequency is located within the border line of the radiating element, surrounded by the first branch so that the SAR value will be smaller than in the arrangement of FIG. 5.

SUMMARY OF THE INVENTION

An object of the present invention is to provide a planar dual-frequency antenna structure which is easy to manufacture and assemble and can be easily dimensioned for the desired operating frequencies. Another object of the invention is that the impedance bandwidth of the antenna be relatively great and that its feed impedance be selectable in a desired manner. A further object of the invention is to provide a radio apparatus utilizing the antenna structure described above.

The objects of the invention are achieved by combining in a single structure a PIFA radiating element and a slotted radiating element. The objects concerning the impedance bandwidth and feed impedance are achieved by providing the combined radiating element with a capacitive feed from the antenna port of the radio apparatus.

The antenna structure according to the invention is characterized in that it has a planar radiating element which comprises a feedpoint and a ground contact near the first end of a dividing slot so that the electrical length of the conductive area divided by the slot, measured at the feedpoint, equals a quarter of the wavelength at the first operating frequency, and the electrical length of the slot equals a quarter of the wavelength at the second operating frequency.

The radio apparatus according to the invention is characterized in that a planar radiating element in its antenna structure comprises, near the first end of a certain slot a feedpoint coupled to the antenna port of the radio apparatus and a ground contact coupled to the ground potential of the radio apparatus, so that the electrical length of the conductive area divided by the slot, measured at the feedpoint, equals a quarter of the wavelength at the first operating frequency, and the electrical length of the slot equals a quarter of the wavelength at the second operating frequency.

In the PIFA structures according to the prior art, two operating frequencies are realized by two PIFA branches with a common feedpoint. In accordance with the invention, the PIFA structure is used as a radiating antenna structure only at the first operating frequency. The antenna of the second operating frequency is a so-called quarter-wave aperture radiator comprised of a slot in the PIFA radiating element. In addition to functioning as a radiating element the slot also tunes down the operating frequency of the PIFA radiating element compared with an equal-sized PIFA without a slot, so that at a certain predetermined operating frequency the structure according to the invention is smaller in size than a prior-art PIFA manufactured without a slot.

The impedance bandwidth of the combined PIFA and slotted radiating element can be made greater by adding in the feedpoint an "extra" series capacitance. "Extra" means that such a capacitance is usually not used: in known PIFA structures the feedpoint is usually in galvanic contact with the antenna port of the radio apparatus. In accordance with the invention it is possible to use a feed pin which is not in galvanic contact with the planar conductive pattern functioning as a PIFA radiating element but there exists a certain insulating layer between the end of said feed pin and the radiating element. The insulating substance may be e.g. air or printed circuit board material.

DETAILED DESCRIPTION OF THE INVENTION

Figure 12:
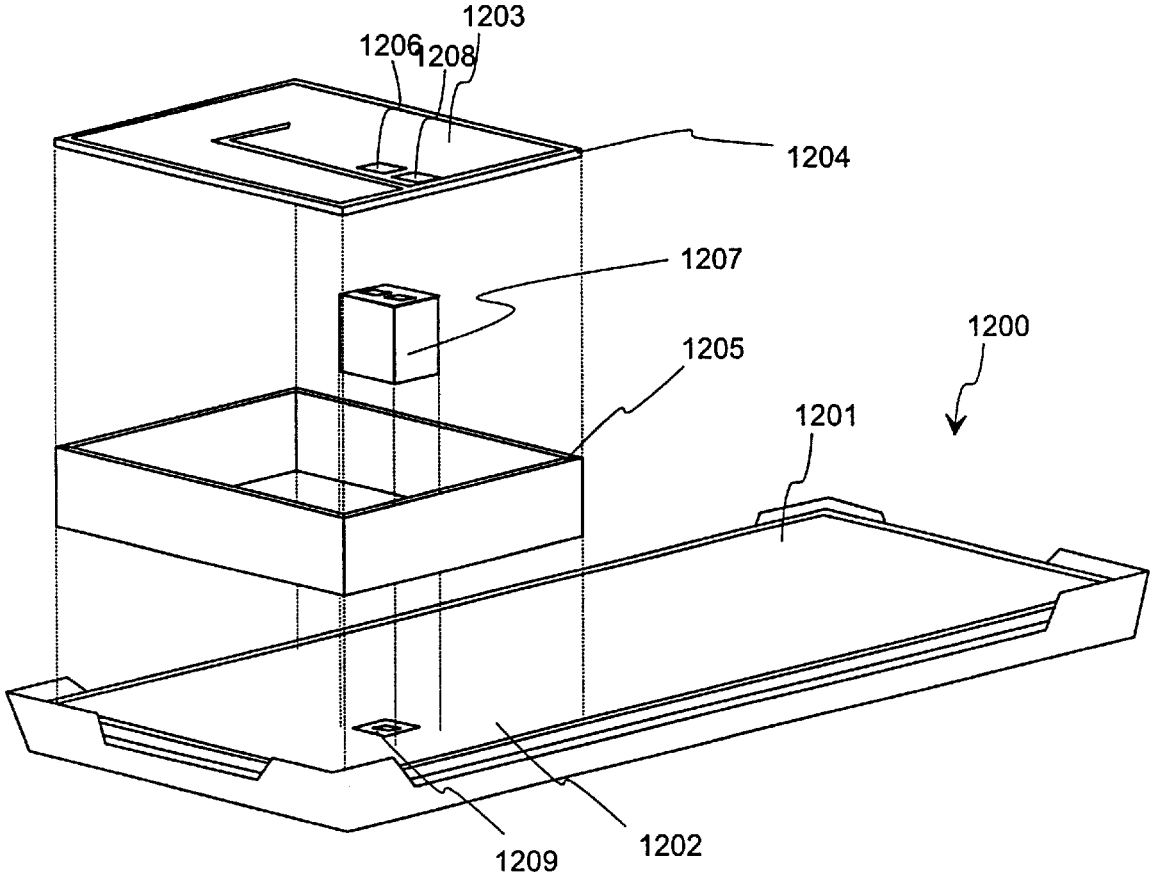
Figure 7:
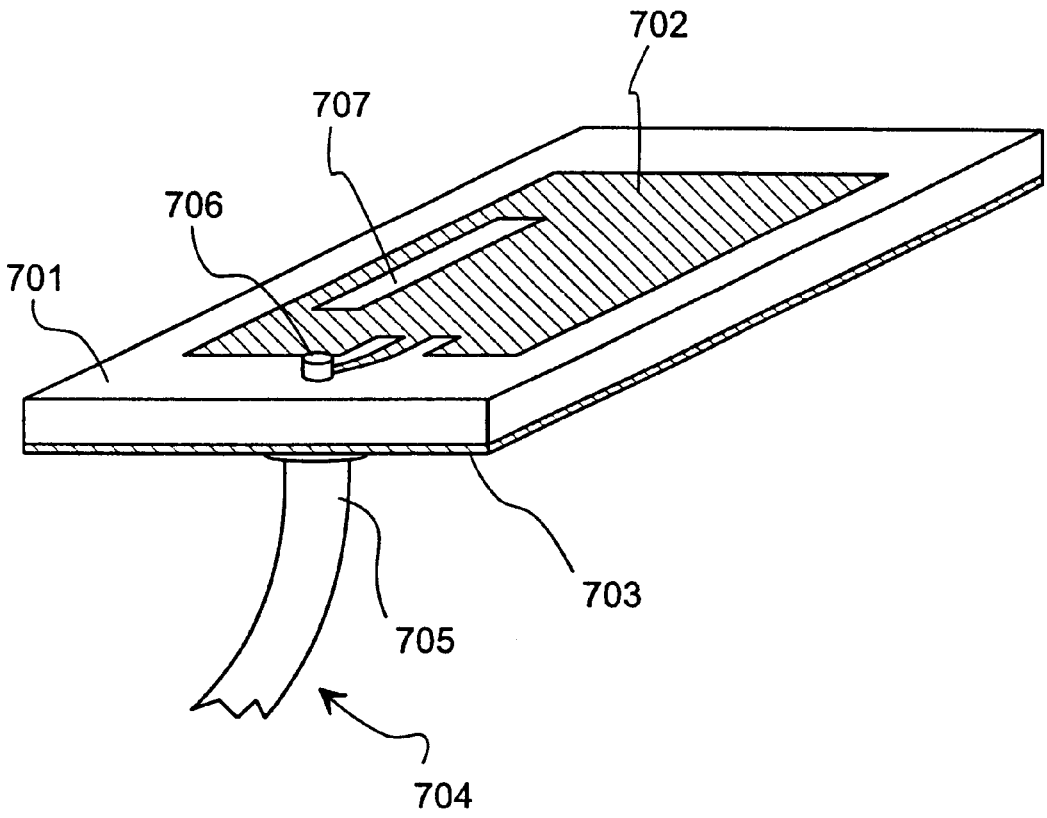
Fig. 7 PRIOR ART
Figure 8:
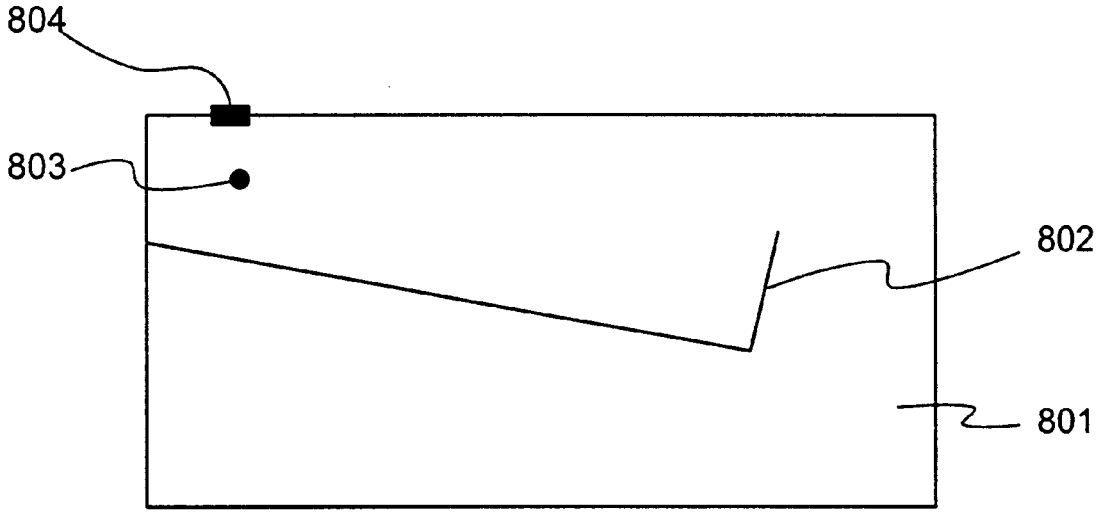
Figure 9A:
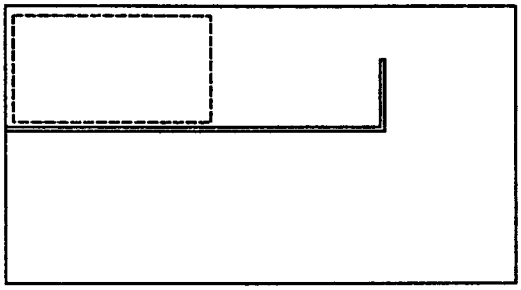
Figure 9B:
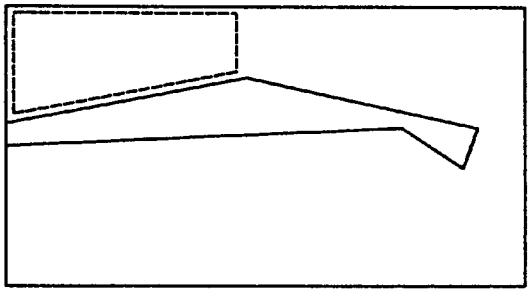
Figure 9C:
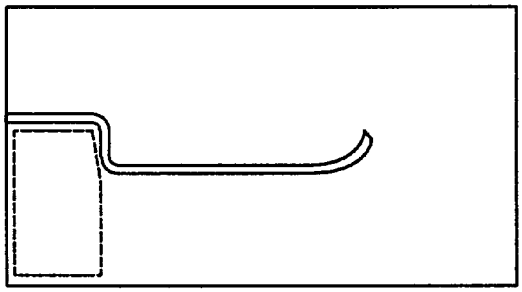
Figure 9D:
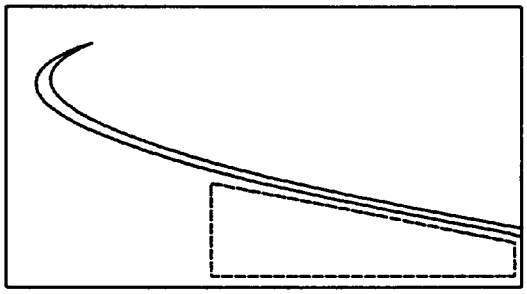
Figure 9E:
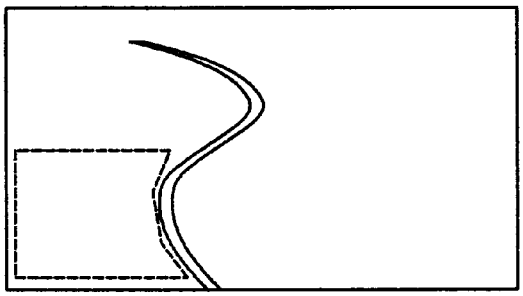
Figure 9F:
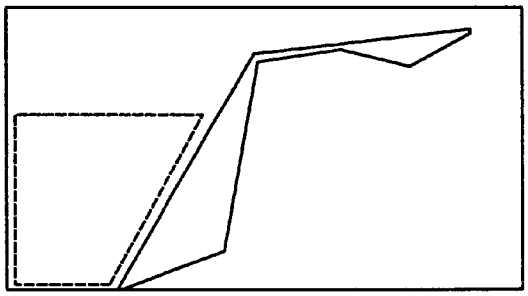
Figure 10:
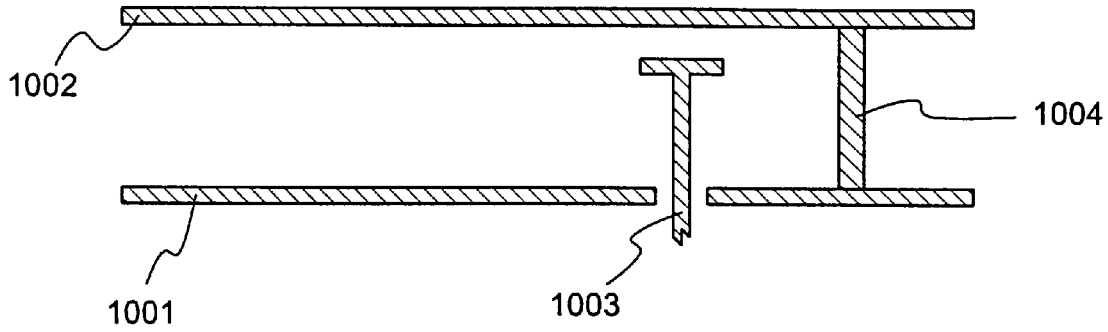
Figure 11A:
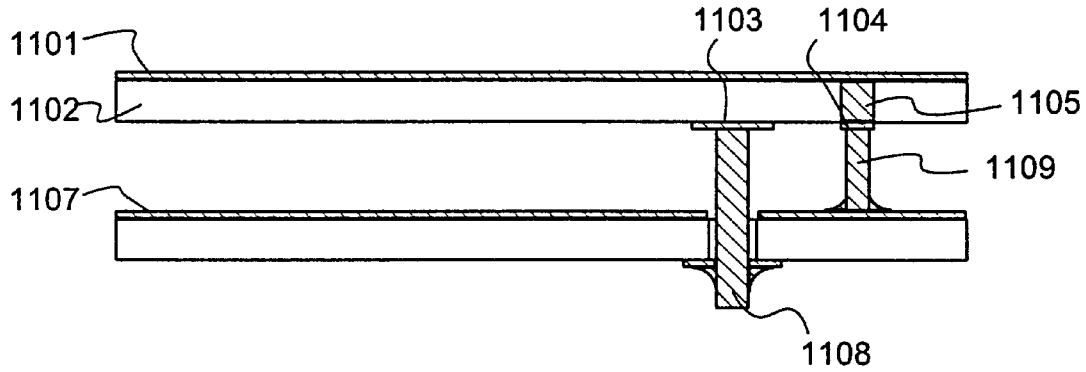
Figure 11B:
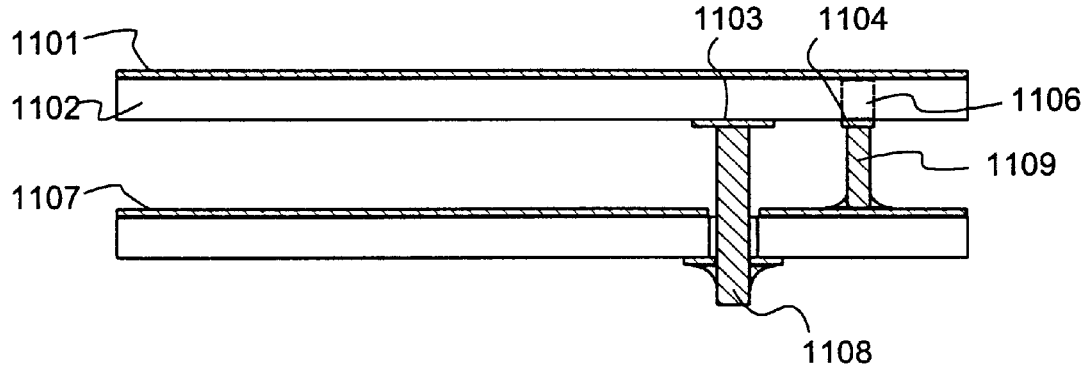
Figure 13:
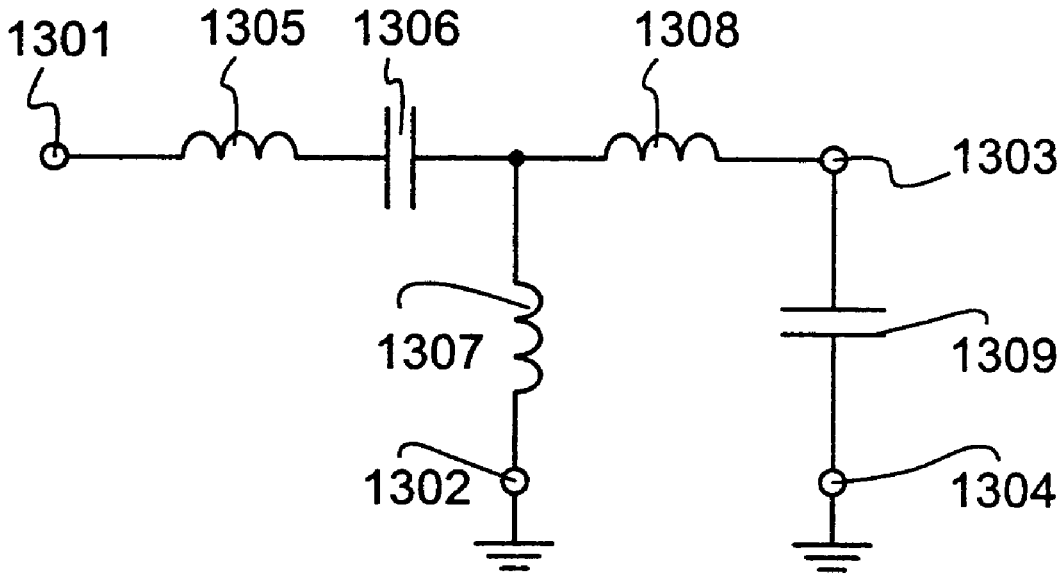

The invention is below described in greater detail referring to the preferred embodiments presented by way of example and to the accompanying drawing in which FIG. 1 illustrates the known basic structure of the PIFA, FIG. 2 illustrates a known PIFA structure, FIG. 3 shows a known planar radiating element design, FIGS. 4*a* and 4*b* show known dual-frequency planar radiating element designs, FIG. 5 shows a third known dual-frequency planar radiating element design, FIG. 6 shows a fourth known dual-frequency planar radiating element design, FIG. 7 shows a known microstrip antenna design, FIG. 8 shows a design of a planar radiating element according to the invention, FIGS. 9*a* to 9*f* show other designs of a planar radiating element according to the invention, FIG. 10 illustrates a feed arrangement according to the invention, FIGS. 11*a* and 11*b* depict alternative implementations of the arrangement illustrated in FIG. 10, FIG. 12 shows an antenna structure according to the invention in a mobile station, and FIG. 13 is an shows an equivalent circuit of capacitive PIFA feed.

Above in connection with the description of the prior art reference was made to FIGS. 1 to 6, so below in the description of the invention and its preferred embodiments reference will be made mainly to FIGS. 7 to 13.

The invention utilizes the principle of a so-called aperture radiating element which is described below, referring to U.S. Pat. No. 4,692,769 and FIG. 7. It should be noted that U.S. Pat. No. 4,692,769 does not deal with PIFA structures but with microstrip antennas which differ from the PEFA principle e.g. as regards the dimensioning at the operating frequency and also in that the radiating planar conductive element in a microstrip antenna has no galvanic contact with the ground plane parallel to it. FIG. 7 shows in a manner known from U.S. Pat. No. 4,692,769 a dielectric substrate 701 having on its upper surface a planar radiating conductive element 702 and on its lower surface a ground plane 703 of which only an edge is shown. The antenna is fed through a coaxial cable 704 the sheath 705 of which is coupled to the ground plane and the inner conductor 706 of which is coupled to the radiating conductive element. The radiating conductive element is basically shaped like a quadrangle (the reference document also discloses a basic circular shape) and has a slot 707 in it the electrical length of which equals half the wavelength at a certain higher operating frequency. The electrical length of the planar radiating element in turn equals half the wavelength at a certain lower operating frequency. In said document the higher operating frequency is 1557 MHz and the lower operating frequency is 1380 MHz which are given by way of example.

The operation of an aperture radiating element is based on the fact that a certain resonant waveform of an electromagnetic field can be excited in a dielectric two-dimensional space surrounded by an electrically conductive material. If the space is elongated, the resonant waveform becomes a standing wave such that it comprises a certain number of nodes and antinodes in the longitudinal dimension of the space. In a slot the both ends of which are closed the resonant frequencies correspond to standing waves which have a node at both ends. The lowest resonant frequency is then the one at which the length of the slot equals half the wavelength. If one end of the slot is closed and the other is open, the resonant frequencies correspond to standing waves which have a node at a first end (the closed end of the slot) and an antinode at the second end (the open end of the slot). In that case the length of the slot equals a quarter of the wavelength at the lowest resonant frequency.

FIG. 8 shows a planar radiating element design in accordance with the invention. The planar radiating element in question is intended to form part of a PIFA structure, which will be described in more detail later on. The radiating element comprises an electrically conductive area 801 confined by a substantially continuous border line and divided by a non-conductive slot 802. One end of the slot is located at a point of the edge of the conductive area (so-called outer end of the slot) and the other end is located at a point within the conductive area (the inner end of the slot). The figure also shows a feedpoint 803 and ground contact 804 which are located near the outer end of the slot.

Unlike the prior-art dual-frequency PIFA radiating elements illustrated in FIGS. 4*a* to 6, the radiating element according to FIG. 8 does not have two separately resonating branches but only one relatively long PIFA branch. This is accomplished by positioning the feedpoint and ground contact close to the outer end of the slot. The PIFA branch functions as a radiating antenna element at the lower operating frequency of the structure. At the higher operating frequency, the radiating element comprises the electrically non-conductive slot in accordance with the above-described principle of the aperture radiating element. Such combining of two antenna principles into one simple structure slightly resembles the solution shown in FIG. 7. However, the ground contact makes this a PIFA structure and not a microstrip antenna as in U.S. Pat. No. 4,692,769. Moreover, it should be noted that the invention requires that the slot be extended right to the edge of the conductive area. The structure according to FIG. 7 will not function in the desired manner unless the slot in the radiating element be surrounded by conductive material from all sides.

Furthermore, the dimensioning of the structure according to FIG. 8 is based on a principle different than that disclosed in U.S. Pat. No. 4,692,769. The starting point is the operating frequency of a PIFA radiating element without a slot. This corresponds to the frequency at which the electrical length of an unslotted PIFA radiating element equals a quarter of the wavelength. The slot decreases the operating frequency of the PIFA radiating element because electrical length of this increases: the decreased frequency is the lower operating frequency of the radiating element shown in FIG. 8. On the other hand, as the feedpoint and ground contact are located close to the outer end of the slot, the slot becomes a slot radiator the electrical length of which equals a quarter of the wavelength at a second frequency which is considerably higher than the lower operating frequency. Said second frequency is the higher operating frequency of the radiating element of FIG. 8.

The invention does not specify a distance between the outer end of the slot and the feedpoint and ground contact, but in order for the structure to operate as desired it will be required that the feedpoint and ground contact be located closer to the outer end of the slot than to the inner end. Moreover, it will be required that if a line be drawn from the feedpoint and ground contact to the outer end of the slot, it is only on one side of the line that there exists a significant portion of the conductive area as regards the electrical length and resonance characteristics. Bearing these limitations in mind one can find a suitable location for the feedpoint and ground contact through experimentation.

FIG. 8 also shows a special detail in the planar radiating element design: the PIFA branch steplessly widens from a certain narrower point towards the outer end, i.e. the end which is farthest away from the feedpoint and ground contact. Such an arrangement makes it possible to somewhat reduce the overall size of the antenna without significantly decrease of the radiation or impedance bandwidth since at the lower operating frequency the radiating antenna element is at its widest where the electric field is at its greatest; that is, at the open end of the branch.

FIGS. 9*a* to 9*f* show alternative designs for a planar radiating element with one PIFA branch and a slot that functions as an aperture radiator. A dashed line confines the area in which the feedpoint and ground contact are advantageously located. The figures show that the slot may comprise straight portions of uniform width, which may also be at right angles to each other (FIG. 9*a*); on the other hand, the slot may also comprise portions of non-uniform width, which portions also become steplessly narrower or wider (FIG. 9*b*); furthermore, the slot may be totally or partly curved (FIGS. 9*c* and 9*d*) or winding (FIG. 9*e*) or it may comprise both portions of uniform width and portions that become narrower or wider (FIG. 9*f*).

FIG. 10 is a longitudinal section depicting the capacitive PIFA's feed, which is an advantageous manner of realizing the feed of the antenna structure according to the invention. The longitudinal section shows a ground plane 1001, planar radiating element 1002, feed pin 1003 and a ground contact 1004. For the feed to operate at all it is essential that the feed pin 1003 (which is coupled to the antenna port of the radio apparatus; not shown) is in no direct galvanic contact with the ground plane 1001 or ground contact 1004. On the other hand, for the feed to be capacitive it is also essential that there be no galvanic contact between the feed pin 1003 and the planar radiating element 1002 but a capacitive coupling through an insulating layer. FIG. 10 presents no special requirements on the insulating layer: it may be e.g. air or another known dielectric material.

In practice, the structure of FIG. 10 can be realized e.g. in such a manner that the planar radiating element 1002 is a metal plate resting on other parts of the radio apparatus e.g. by means of a support frame located along the edge of the plate or by attaching it to a dielectric part in the casing of the radio apparatus, and the ground plane 1001 comprises a metallization either on the surface of a printed circuit board belonging to the radio apparatus or in a certain part of the casing structure of the radio apparatus. The feed pin and ground contact may be realized as metal strips or pins which are supported e.g. by a separate support structure made of plastics or other dielectric material. In a longitudinal section of a constructional drawing, such a structure would not significantly differ from the conceptual drawing shown in FIG. 10.

FIGS. 11*a* and 11*b* illustrate a second method for realizing the structural principle according to FIG. 10. Referring to the figures, a planar radiating element 1101 has been formed on a first surface of a printed circuit board 1102, said first surface being the upper surface in the figures. Coupling pads 1103 and 1104 for feed and grounding have been formed on a second surface (the lower surface in the figures) of the same printed circuit board. Feeding happens capacitively through the printed circuit board 1102, but to realize grounding, a galvanic contact must be provided between the ground coupling pad 1104 and the planar radiating element 1101 either through a metal-plated hole 1105 or by means of metallization 1106 along the edge of the printed circuit board. The ground plane 1107 may in this structure, too, be a metallization on the surface of another printed circuit board or it may be realized by metallizing a given part of the casing structure of the radio apparatus. FIGS. 11*a* and 11*b* utilize the first alternative, whereby the feed pin 1108 can be soldered to a hole (around which there is on the surface facing the ground plane a non-conductive area which isolates the feed pin from the ground plane) in the grounding printed circuit board, and the ground contact 1109 may be formed of a metal strip or pin which is soldered or otherwise attached to the ground plane. Instead of or in addition to simple pins it is possible to use various known flexible pin structures that flex in the longitudinal dimension (perpendicular to the planar radiating element and ground plane) so that in the finished construction the spring force caused by the flexibility presses at least one end of the pin against the surface onto which the pin is placed but not otherwise attached.

FIG. 12 shows an advantageous arrangement for an antenna structure in a radio apparatus where the radiating element is a combination of a PIFA and a slotted radiating element in accordance with the invention. The exemplary radio apparatus is here a mobile phone 1200 which is shown with the outer casing opened such that the keypad, display and loudspeaker, which are known components of a mobile phone, face down and therefore are not shown in the figure.

A first printed circuit board 1201 or another substantially planar surface inside the mobile phone comprises a ground plane 1202 which is a substantially continuous electrically conductive area. A ground plane formed on a printed circuit board may be located on the surface of the circuit board or in an intermediate layer of the circuit board. A planar radiating element 1203 is formed on the surface of a second printed circuit board 1204 which is attached to the first printed circuit board by means of a frame 1205. A feedpoint 1206 is connected to the antenna port 1209 of the radio apparatus in such a manner that the coupling through the printed circuit board 1204 to a connector block 1207 is capacitive, and from there on connection is provided by a feed pin which comprises a microstrip on the surface of the connector block. In this embodiment, the same connector block provides the connection between the ground contact 1208 and ground plane 1202.

FIG. 13 shows an equivalent circuit to illustrate the characteristics of a capacitive PIFA's feed. Node 1301 in the circuit corresponds to the antenna port of a radio apparatus, node 1302 corresponds to the ground contact in the PIFA, node 1303 corresponds to the open end of the PIFA and node 1304 corresponds to the ground plane. Inductance 1305 represents the inductance of the feedline, or the line between the antenna port of the radio apparatus and the capacitively coupled feedpoint, capacitance 1306 represents the capacitance of the capacitive feed, inductance 1307 represents the inductance between the antenna feedpoint and ground contact, inductance 1308 represents the inductance of the PIFA element, and capacitance 1309 represents the capacitance between the open end of the PIFA element and ground plane. The figure shows that the feedline inductance 1305 and the feedpoint capacitance 1306 form a series resonant circuit between the antenna port of the radio apparatus and the antenna feedpoint.

The value of capacitance 1306 can be adjusted by varying the size of the feedpoint coupling pad (1103 in FIG. 11) and choosing desired values for the thickness and permittivity of the printed circuit board that supports the radiating antenna element: a rough estimate for the value of the capacitance C may be calculated as follows:

$$C = \varepsilon_0 \varepsilon_r \frac{A}{d},$$

where $\epsilon_0$ is the permittivity of vacuum, $\epsilon_r$ is the relative permittivity of the printed circuit board material, A is the area of the coupling pad and d is the thickness of the printed circuit board material. The value of capacitance 1306 influences the resonant frequency of said series resonant circuit. With suitable dimensioning this frequency can be set so as to be near the PIFA's own resonating, or operating, frequency, thereby making the impedance bandwidth of the antenna up to double that of a galvanically fed PIFA. In a dual-frequency antenna structure the bandwidth-widening effect of the series resonance may be directed as desired to either the higher or the lower operating frequency; generally it can be said that the effect of the series resonance in an antenna structure may be shifted from a higher operating frequency to a lower one by making the capacitive feed coupling pad bigger. Typically, in dual-frequency or multi-frequency antennas, there is one operating frequency which has an impedance bandwidth inherently narrower than the other operating frequencies so that the bandwidth-widening effect of the capacitive feed is preferably directed to that particular operating frequency.

The above-described embodiments of the invention are presented by way of example only and do not limit the invention. For example, the planar radiating element and ground plane need not be absolutely planar but their shape may be e.g. curved as in the prior-art antenna structure shown in FIG. 2. The frame 1205 which is shown continuous in FIG. 12 may also comprise separate parts and it need not cover the whole length of the edge of the printed circuit board 1204 if sufficient mechanical stability is achieved by resting only certain parts of the edge on other parts of the radio apparatus.

What is claimed is:

1. A PIFA structure having a first operating frequency and a second operating frequency, comprising:

a planar radiating element formed by a conductive area confined by a substantially continuous border line, said area being divided by a non-conductive slot which has a first end on said substantially continuous border line and a second end within the conductive area, said element comprising:

a feedpoint and ground contact respectively located near the first of end of the slot, wherein the electrical length of the conductive area divided by the slot, measured at the feed-point, equals a quarter of the wavelength at the first operating frequency and the electrical length of the dividing slot equals a quarter of the wavelength at the second operating frequency.

2. The PIFA structure according to claim 1, further comprising:

a capacitive feed, wherein the feedpoint is arranged such that it is coupled capacitively to a feed pin.

3. The PIFA structure according to claim 2, further comprising:

a first printed circuit board having a first surface and a second surface, wherein the planar radiating element is arranged on the first surface of said first printed circuit board a coupling pad is arranged on the second surface to provide connecting a connection to said feed pin, and the feedpoint is arranged to be coupled capacitively to the feed pin through the first printed circuit board.

4. The PEFA structure according to claim 3, further comprising:

a ground pin, and wherein the first printed circuit board has an electrically conductive through hole to provide galvanic coupling between the ground contact and ground pin.

5. The PEFA structure according to claim 3, further comprising:

a ground pin, and an electrical conductor extending around an edge of the first printed circuit board, from the first surface to the second surface, to provide galvanic coupling between the ground contact and ground pin.

6. The PIFA structure according to claim 2, wherein said planar radiating element is a substantially planar electrically conductive plate and the structure comprises, at the feedpoint, a feed pin which is substantially perpendicular to the planar radiating element and separated from the planar radiating element by an empty gap.

7. The PIFA structure according to claim 1, wherein the the non-conducting slot has one of a straight shape, a fraction line shape comprised of straight portions, curved portions and winding portions, and an area comprised of elongated portions having varying widths.

8. A radio apparatus having a first operating frequency and a second operating frequency, comprising:

an antenna port (1209, 1301), and as an antenna, a PIFA structure having a first operating frequency and a second operating frequency which correspond to the first operating frequency and second operating frequency of the radio apparatus, and which PIFA comprises a planar radiating element (801, 1002, 1102, 1203) which is a conductive area confined by a substantially continuous border line and divided by a non-conductive slot (802) which has a first end on said substantially continuous border line and a second end within the conductive area, comprising:

a feedpoint (803, 1206) coupled to the antenna port of the radio apparatus and a ground contact (804, 1208) coupled to the ground potential of the radio apparatus, wherein said feedpoint is located near the first of end of the slot so that the electrical length of the conductive area divided by the slot, measured at the feedpoint, equals a quarter of the wavelength at the first operating frequency and the electrical length of the slot equals a quarter of the wavelength at the second operating frequency.

9. The radio apparatus according to claim 8, wherein the coupling between the feedpoint of the planar radiating element and the antenna port of the radio apparatus is capacitive.

10. The radio apparatus according to claim 8, further comprising:

a dielectric frame which supports edges of the planar radiating element on a mechanical structure of the radio apparatus.

* * * * *